US007418959B2

(12) United States Patent
Kingsley et al.

(10) Patent No.: US 7,418,959 B2
(45) Date of Patent: Sep. 2, 2008

(54) CONCRETE SAW HANDLE BARS

(75) Inventors: Michael Kingsley, Wellsville, KS (US); Douglas Dempsey, Pleasant Hill, MO (US); Donald F. Meister, Overland Park, KS (US); Robert Michael Kennedy, St. Joseph, MO (US)

(73) Assignee: Husqvarna Outdoor Products Inc., Augusta, GA (US)

( * ) Notice: Subject to any disclaimer, the term of this patent is extended or adjusted under 35 U.S.C. 154(b) by 0 days.

(21) Appl. No.: 11/176,753

(22) Filed: Jul. 7, 2005

(65) Prior Publication Data

US 2006/0005826 A1 Jan. 12, 2006

Related U.S. Application Data

(60) Provisional application No. 60/586,772, filed on Jul. 9, 2004.

(51) Int. Cl.
*B28D 1/04* (2006.01)

(52) U.S. Cl. ..... 125/13.01

(58) Field of Classification Search ..... 125/13.01, 125/13.02, 13.03, 14, 15, 16.01, 16.02, 12; 299/39.3; 280/47.315, 655, 655.1; 403/110, 403/97; 404/90

See application file for complete search history.

(56) References Cited

U.S. PATENT DOCUMENTS

| | | | | |
|---|---|---|---|---|
| 2,468,336 | A | 4/1949 | Lewis | |
| 2,889,141 | A | 6/1959 | Wilson | |
| 2,938,734 | A | 5/1960 | Guimond | |
| 2,973,950 | A | 3/1961 | Tucker | |
| 3,513,924 | A | 5/1970 | Jackson | |
| 3,995,650 | A | 12/1976 | DiVito | |
| 4,023,436 | A | 5/1977 | Dodge | |
| 4,253,649 | A | 3/1981 | Hewson | |
| 4,664,645 | A | 5/1987 | Muck et al. | |
| 4,840,431 | A | 6/1989 | Jedick | |
| 5,039,118 | A | 8/1991 | Huang | |
| 5,477,844 | A | 12/1995 | Meister | |
| 5,680,854 | A | 10/1997 | Kingsley et al. | |
| 5,709,200 | A * | 1/1998 | Mertes | 125/13.01 |
| 5,725,282 | A | 3/1998 | Masseth, Jr. et al. | |
| 5,743,247 | A | 4/1998 | Kingsley et al. | |
| 5,809,985 | A | 9/1998 | Kingsley et al. | |
| 6,019,433 | A * | 2/2000 | Allen | 299/39.3 |
| 6,101,678 | A * | 8/2000 | Malloy et al. | 16/438 |
| 6,318,351 | B1 * | 11/2001 | Baratta | 125/12 |

* cited by examiner

*Primary Examiner*—Jacob K Ackun, Jr.
(74) *Attorney, Agent, or Firm*—Henricks, Slavin & Holmes LLP

(57) ABSTRACT

A handle support and adjustment assembly for a saw allows the handle to be adjusted in length and/or angle relative to the saw.

12 Claims, 5 Drawing Sheets

CONCRETE SAW HANDLE BARS

CROSS REFERENCE TO RELATED APPLICATIONS

This application claims benefit of priority to U.S. Provisional Patent Application Ser. No. 60/586,772, filed Jul. 9, 2004.

BACKGROUND

1. Field

The present disclosure relates to equipment that can be maneuvered manually, for example concrete saws having a portion that may be lifted or raised, relative to a surface, using handles or other manual elements at another portion of saw. Such saws may include industrial concrete saws for cutting and grooving concrete slabs.

2. Related Art

In the concrete industry, large slabs of concrete are used to form road beds, building floors and other structures used for its strength and durability. Seams, grooves or other cuts in the concrete may be made in the slabs to form expansion joints, control stress cracks as the slabs cure or to form channels or openings in the slabs to accept other structures. Concrete saws are used to cut the seams, grooves or other openings, and such concrete saws are often very heavy and difficult to move along the concrete slab.

For large or heavy construction applications, heavy self-propelled saws or other large concrete saws are used. Examples of concrete saws and their construction and operation can be found in a number of patents, including U.S. Pat. No. 5,809,985, entitled "Self-Propelled Saw," U.S. Pat. No. 5,743,247, entitled "Method and Apparatus for Safe Operation of Self-Propelled Concrete Saw," U.S. Pat. No. 5,680,854, entitled "Self-Propelled Saw," U.S. Pat. No. 5,477,844, entitled "Slurry Recovery System for a Wet Cutting Saw," and U.S. Pat. No. 4,664,645 entitled "Blade Drive Shaft Assembly," all of which are incorporated herein by reference. During setup and operation of the saw, an operator walks behind the saw to control the direction, cutting speed, cutting depth and other operating conditions under which the saw operates. The saw includes one or more wheels allowing the saw to move along the concrete and a frame supported by the wheels on which is mounted a motor or other power supply for operating a saw blade and often for driving one or more wheels to move the saw along the concrete surface. One or more handles extend behind the saw about the level of an operator's hands to allow the operator to manually position the saw. Typically, the saw blade is in the front of the saw and handles extend behind the saw.

For a typical straight cut, the operator aligns the saw blade and often a cutting guide with the intended cutting path. The saw is maneuvered with the saw blade raised above the concrete until the blade and cutting guide are aligned with the cutting path. With the saw blade raised, the orientation of the entire saw is pivoted typically about an axis common to rear drive wheels, and the handles are thereby lowered a corresponding amount. See for example FIG. 1 in the U.S. Pat. No. 5,477,844 patent. The entire saw may tilt as much as 30 degrees, pivoting on the rear wheels near the operator. The operator guides the saw travel by lifting and pushing or pulling on handle bars. With the handles lowered, the operator may be stooped over in an uncomfortable position while at the same time trying to maneuver the heavy saw. Maneuvering the saw may often include turning or moving the saw to one side or the other while pushing down or pulling up on the handles or to make easier the positioning of the saw blade. Consequently, the operator's hands change position with the handles often resulting in the operator being stooped over while moving the heavy saw.

Saw handle bars can be repositioned by removing the handle bar from the saw and re-inserting it in a different position that better accommodates the operator's preferences. A handle bar lock mechanism is released to remove the handle bars and tightened after they are repositioned. However, the alternate handle bar position may not be suitable for other operators, depending on the preferences of the operators.

SUMMARY

One or more aspects of the apparatus and methods described herein permit a saw handle to be adjusted. The saw handle can be adjusted in length, and/or the saw handle can be adjusted in angle relative to the rest of the saw. Adjustment of the handle bar height and angle can be made easily and quickly, and adjustments can be made to an infinite or large number of positions within the range of motion of the handle to accommodate the preferences of an operator.

In one example of the apparatus and methods described herein, a piece of equipment that can be positioned in part through one or more handles, for example a concrete saw, includes a handle having a free end that can be positioned at various positions spaced from the rest of the equipment.

For example, a saw handle can be adjustable by increasing or decreasing the overall length of the handle, thereby positioning the free end of the handle further way from or closer to the rest of the saw. In another example, the saw handle can be adjustable by changing the angle of the saw handle relative to the saw. In a further example, the saw handle can be adjustable by changing its length and the angle relative to the rest of the saw either separately by length or angle or simultaneously in length and angle.

In another example of the apparatus and methods described herein, a concrete saw includes a handle having a free end spaced from the saw, whereby the spacing of the free end relative to the saw can be adjusted continuously, as opposed to discrete, pre-defined positions. For example, the length of the handle can be changed continuously over a range, and the angle of the handle relative to the saw can be changed continuously over a range. In one configuration, the handle position can be set with a relatively quick, single-motion device.

In a further example of the apparatus and methods described herein, a concrete saw includes a handle having a free end spaced from the saw, an attachment portion spaced from the free end and a pivot portion between the free end and the attachment portion. In one configuration, the attachment portion is configured to allow the handle to pivot about the pivot portion through an arc.

These and other aspects of the apparatus and methods described herein will be considered in more detail in conjunction with the drawings, a brief description of which follows.

DETAILED DESCRIPTION

The following specification taken in conjunction with the drawings sets forth the preferred embodiments of the present inventions in such a manner that any person skilled in the art can make and use the inventions. The embodiments of the inventions disclosed herein are the best modes contemplated by the inventor for carrying out the inventions in a commercial environment, although it should be understood that various modifications can be accomplished within the parameters of the present inventions.

Apparatus and methods are described for equipment, for example concrete saws, that can be manually moved or positioned through use of one or more handles. Adjustable handles allow easier positioning of the saw and permits accommodation of the preferences of different operators. The handles are preferably adjustable in more than one dimension, including in the angular and the longitudinal directions.

Figure 1:
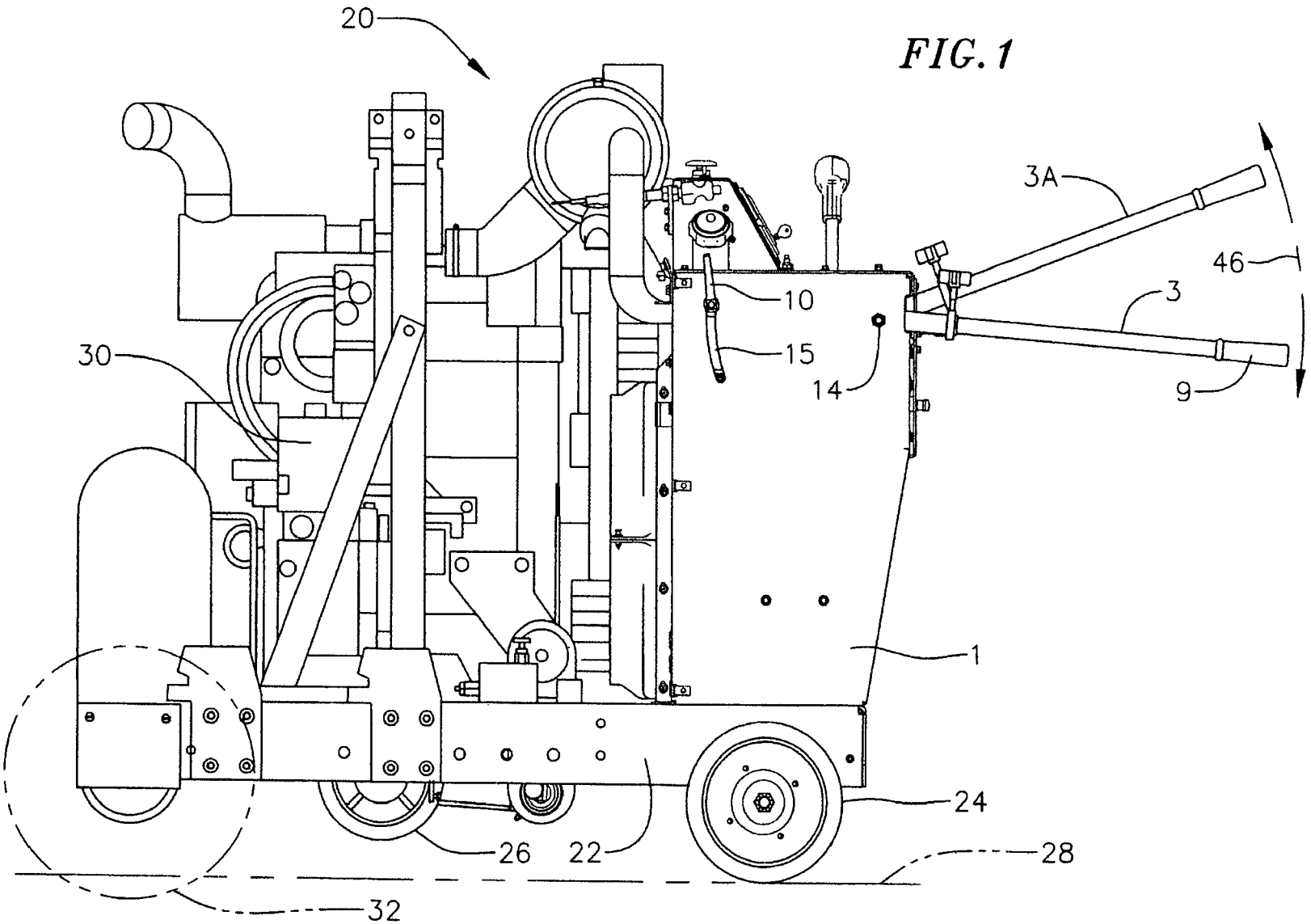
FIG. 1 is a side elevation view of a piece of equipment in the form of a concrete saw that can be positioned manually and that includes adjustable handles.

In one example of a saw, a concrete saw 20 (FIGS. 1 and 2) includes a frame 22 supported by wheels 24 and 26. The wheels 24 and 26 allow the saw to move across a concrete surface 28 (FIG. 1). Details about the construction and configuration of a concrete saw are provided in the above-identified patents.

An internal combustion engine 30 may be mounted to the frame 22 and may provide power both to rotate the saw blade 32 (shown schematically) and to operate, through a transmission, the drive wheels 24 to propel the concrete saw. The engine 30 includes a crank shaft (not shown) which drives a pulley around which is positioned a V-belt or drives another drive element for the saw blade and typically another belt for a transmission for driving the drive wheels 24.

As shown in FIG. 1, the engine 30 is supported on the frame 22 generally forward of the drive wheels 24. The blade 32 is supported on the frame generally forward of the engine 30. Because the blade can often have a large diameter, for example greater than two feet, the saw blade is raised above the surface of the concrete by pushing the wheels 26 downward against the concrete surface, thereby raising the frame 22 relative to the concrete surface. As a result, the saw pivots around the common axis for the drive wheels 24, and as the blade 32 is raised, handles 3 and 3A move down closer to the concrete surface. As the blade begins cutting in the concrete, the saw pivots back toward the concrete surface until the saw blade reaches the desired depth. Once the desired depth is reached, the saw can be advanced along the cut path.

Figure 2:
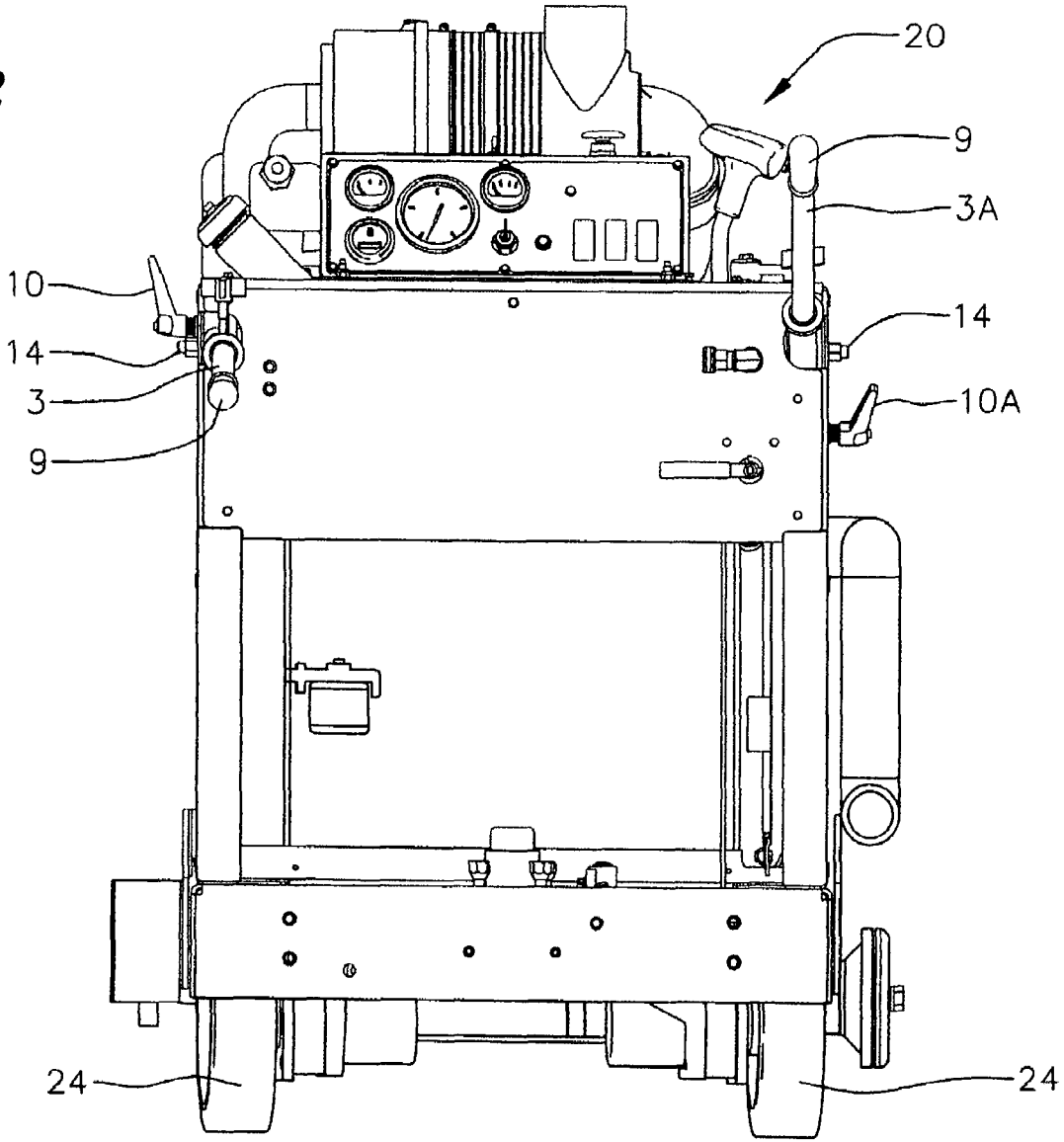
FIG. 2 is a rear elevation view of the concrete saw of FIG. 1.

In the example shown in FIGS. 1 and 2, two handles 3 and 3A are shown, generally on opposite sides of the saw. While two handles are common, it should be understood that a single handle can be used on a saw to move and position the saw. The two handles 3 and 3A are preferably substantially identical and configured to be mirror images of each other as they are configured for use on the saw 20. However, the handle 3 will be considered in more detail but it should be understood that similar comments apply with respect to the configuration, use and adjustability of the handle 3A.

Figure 3:
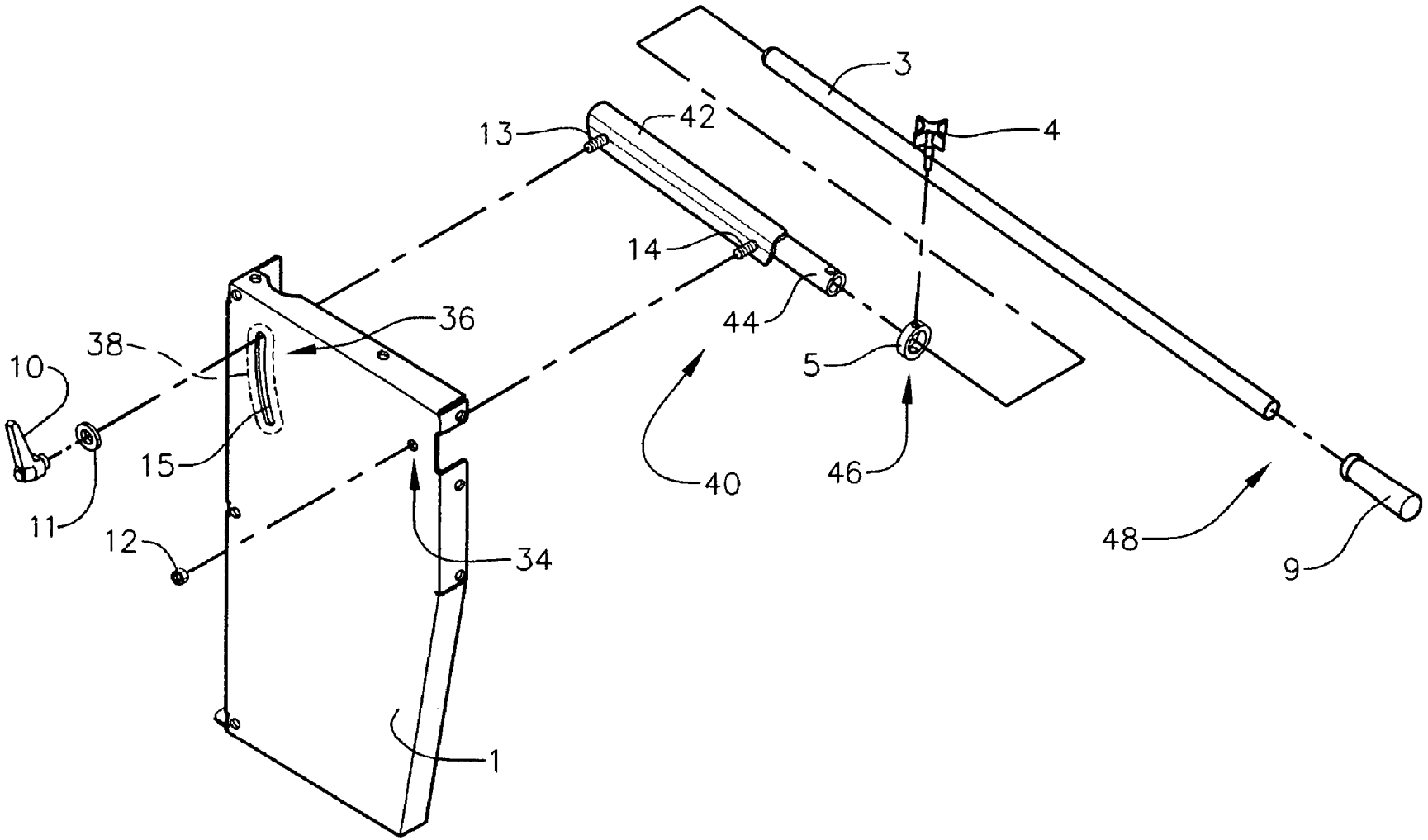
FIG. 3 is an exploded view of a handle adjustment assembly for use with the saw of FIG. 1.

In the example of the saw shown in FIGS. 1-3, the saw handles are adjustable in height and in length or both. In one configuration, at least one and preferably both handles have handle adjustment assemblies including releasable height holding elements and also including releasable length holding elements. The holding elements are releasable to allow the handle positions to be adjusted. Each of the height and length holding elements are preferably configured to reliably hold the handle in the selected position until released for adjustment or storage. The handle adjustment assembly will be discussed in more detail further below.

The handle adjustment assembly, and therefore the handle 3, is supported relative to the frame by the frame side plate. The portion of the frame that supports the handle adjustment assembly can take a number of configurations and have a number of functions, but the frame side plate 1 described herein will be the frame element in the present example used for supporting the handle, as described more fully herein. The frame side plate includes a pivot support 34 and a travel support 36. In the present examples, the travel support is configured to include an arcuate opening or arcuate path, to accept arcuate movement of a portion of a handle adjustment described more fully below, and will be termed an arc support 36. However, the travel support can take a number of other configurations. The pivot support 34 supports a pivot point or pivot portion for allowing the handle to pivot about the pivot support 34. The arc support 36 supports a structure that allows a portion of the handle 3 to move through an arc as defined by the configuration of the arc support 36. While the arc support 36 is shown as having a relatively uniform curvature, the support 36 can have other configurations other than a uniform arc while still allowing a portion of the handle to be adjustable relative to the saw. In the configuration shown in FIGS. 1-3, the arc support 36 allows a portion of the handle to move through a relatively uniform arc. The arc support 36 also preferably includes a surface or other material designated generally at 38 that allows the handle to be releasably fixed in position relative to the frame side plate 1. In the configuration shown in FIG. 3, the surface 38 is the material surface adjacent an arc opening 15, which surface may be formed, treated or otherwise configured to assist in securely holding the handle in the desired position along the arc opening 15.

The handle adjustment assembly 40 (FIG. 3) is supported by the frame in the frame side plate 1, and supports the handle 3. It allows the handle position to be adjusted relative to the frame side plate 1, and therefore relative to the rest of the saw. The handle adjustment assembly 40 includes a pivot element 14, which may be a pin, a pin and sleeve, a swivel, pivot cylinder or pivot stud supported in the frame side plate so that the handle adjustment assembly is pivotable relative to the rest of the saw, and so that the handle height can be adjusted relative to the frame. In the present example, the pivot element is a pivot pin 14 that extends to and preferably through an opening defining the pivot support 34 of the frame side plate, and is captured within the opening by a nut, fastener or other securement 12. The pivot pin 14 supports the handle adjustment assembly 40 in the frame and allows it to pivot relative to the frame. The pivot pin in the present examples when supported in the frame side plate is fixed vertically and horizontally, as viewed from the side of the saw, such as the view of FIG. 1, and only pivots. The handle preferably extends sufficiently close to the frame side plate 1 so as to have a relatively small side load on the pivot pin 14 when an operator pushes down or pulls up on the handle. Similarly, the length of the pivot pin 14 between its attachment point to the rest of the handle adjustment assembly and where the fastener 12 is applied is small, to reduce side loading on the pivot pin.

The handle adjustment assembly 40 in the example shown in FIG. 3 also includes a travel element, which in the present example takes the form of a threaded pin 13. The travel element could also take the form of a bar, rod, or arc element for traveling in an arc within the arc support 36. The pin 13 extends into the opening defined by the arc opening 15 and is captured therein to releasably support the handle adjustment assembly 40 with the frame. In the configuration shown in FIG. 3, the threaded pin 13 is held in the arc opening 15 by a releasable holding element 10. The holding element releasably holds the threaded pin against the surface 38, and allows the handle height to be adjusted relative to the frame. The threaded pin 13 and the pivot pin 14 allow height adjustment of the handle relative to the frame of the saw. They provide a relatively strong support for the handle through the frame side wall 1 and the handle adjustment assembly 40.

Figure 4:
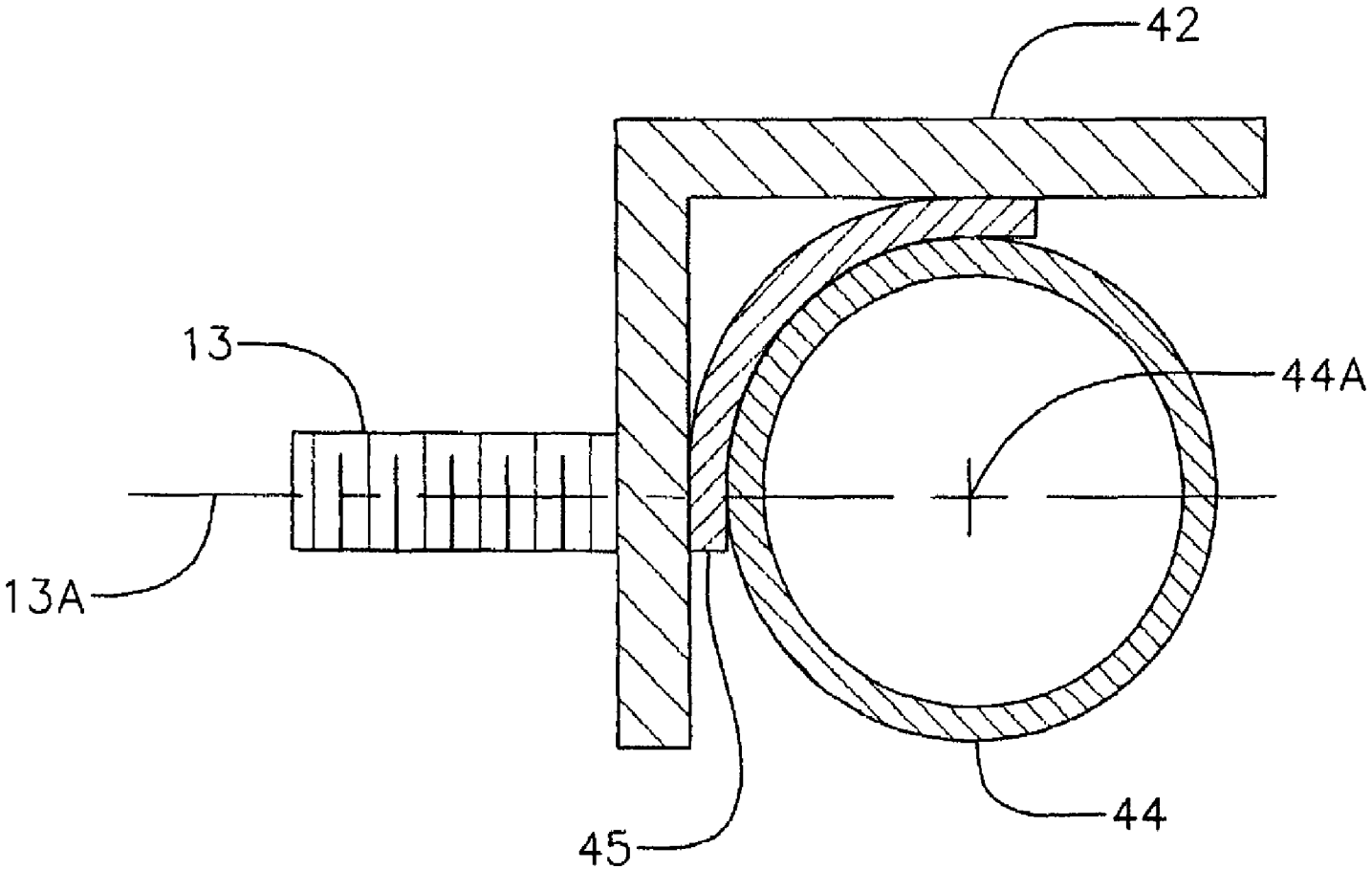
FIG. 4 is a cross section of a schematic of another example of a handle adjustment assembly similar to that shown in FIG. 3 including a damping material.

The threaded pin 13 in the examples herein joins the handle adjustment assembly 40 at a handle support 44 (described more fully below). The threaded pin 13 extends in the present examples substantially normal or perpendicular to the handle adjustment assembly and specifically to the handle support 44, so that the pin 13 has an axis 13A (FIG. 4) that is substantially perpendicular to the central axis 44A of the handle support 44. Having the axis 13A of the pin intersect or nearly intersect the handle support axis 44A reduces any tendency of a significant moment or bending load being created in the threaded pin 13 when an operator pushes down or pulls up on the handle grip 9.

The releasable holding element 10 may take the form of a clamp, retainer, fastener or other mechanism. In the examples described herein, the holding element will be referred to as clamp 10. The clamp 10 may be a KIPP design adjustable handle Model No. 28061, or another locking handle that is preferably multiple position, instantly adjustable and lockable and releasable. A spacer or bearing element such as washer 11 may be included to help releasably hold the threaded pin against the surface 38 until it is released.

The configuration of the mechanism for releasably holding the threaded pin against the surface 38 may take the form of a handle, clamp or other securement mechanism such as those that may be obtained from commercially available sources. Other possible mechanisms may include trigger ratchets, thumb knobs, and the like. The mechanism for releasably holding the threaded pin relative to the frame, and therefore selecting the arc or angle position of the handle relative to the rest of the saw, can be positioned as desired over an essentially infinite number of locations along a continuum over the defined range of motion, as defined by the arc opening 15.

The angular position of the handle need not be set at discrete or predefined positions. The use of a handle or clamp 10 such as that shown in FIG. 3 allows for quick setting of the position of the handle, in this case the angular position of the handle. It also allows for setting of the position at a number of locations along the length of travel.

The pivot pin 14 and the threaded pin 13 are preferably fixed relative to each other. Additionally, they are spaced apart from each other a sufficient distance to more evenly distribute over the handle adjustment assembly any loading created when an operator pushes down, pulls up on or otherwise moves the handle. In the example shown in FIGS. 1 and 3, the pivot pin 14 is located close to the rear of the frame side wall 1, and the threaded pin 13 is located close to the front of the frame side wall 1. Additionally, in the example of FIG. 3, the threaded pin 13 is located close to the far end of the handle adjustment assembly, remote from the handle grip 9, to take advantage of any additional spacing that can be used between the pivoting portion of the handle adjustment assembly and the traveling portion of the handle adjustment assembly.

In the configuration shown in FIG. 3, the handle adjustment assembly includes a support element, and the pivot pin 14 and the threaded pin 13 are mounted to and form part of the support element 42. The support element 42 in turn supports a handle support 44 relative to the frame. It should be understood that the support element 42 and the handle support 44 can be formed integral or monolithic with respect each other, or they can have a number of other configurations. The handle support is releasably held to the frame wall, and when the handle is held in the handle support, the handle is also releasably held relative to the frame wall.

Figure 5:
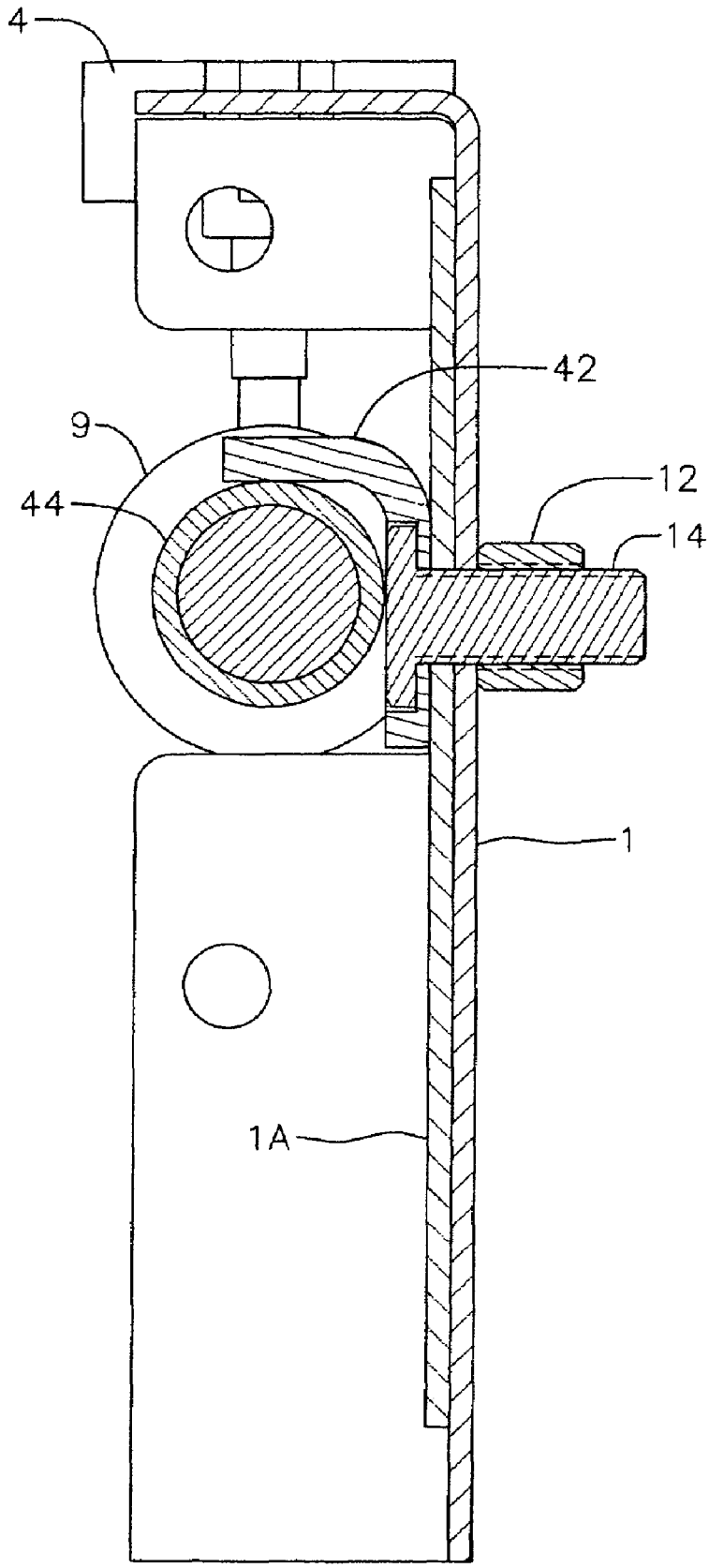
FIG. 5 is a vertical cross section of a portion of the handle adjustment assembly of FIG. 3 showing the pivot area for the handle adjustment assembly.

The handle support 44 is preferably fixed, such as by welding or other reliable means, to the support element 42. The handle support 44, if desired, may also include between the handle support and the support element 42 a damping material 45 (FIG. 4), in this example a cushion or other material such as rubber or foam, to absorb vibration, and the like. In the example shown in FIG. 5, the handle support 44 is fixed to the support element 42 without a damping element. Additionally, the support element 42 is configured so that the pivot pin 14 is received in an inside surface of the support element so that a head on the pivot pin rests in a recess or cavity so that the head of the pivot pin 14 is flush with the support element 42. A plate element may extend between the support element and the frame side wall 1, for example for additional support of the handle adjustment assembly in the frame.

The handle support 44 preferably receives the handle 3 and, along with other parts of the handle adjustment assembly 40, allows the handle to be adjusted relative to the rest of the saw. With the handle adjustment assembly 40, the handle can be adjusted in length and in the angle at which the handle extends relative to the saw (see the arrow 46 in FIG. 1). The handle adjustment assembly 40 can also be configured so as to allow the handle to be adjusted in ways other than the handle length and/or angle relative to the rest of the saw.

In the configuration shown in FIG. 3, the handle support 44 is a tube, pipe, or other receptacle for receiving and supporting the handle 3. The handle support 44 is a circular tube, but it should be understood that the support can take a number of different shapes, opening configurations and surface configurations, both internal and external. In the configuration shown in FIG. 5, the inside surface of the handle support 44 is complementary to the circular external surface configuration of the handle 3. However, other surface combinations are possible. The dimensions of the handle support 44 are preferably such as to reliably support the saw when the handles are used to raise, move and position the saw. The handle support 44 may be closed at the end opposite handle 3.

The handle adjustment assembly 40 may include a releasable locking mechanism 46 for locking the handle 3 in a longitudinal position relative saw. Longitudinal positioning of the handle is preferably carried out independently of the positioning of the height of the handle. This can be done using separate locking mechanisms, such as those shown in FIG. 3, spaced apart from each other, and also locking at different parts of the handle adjustment assembly. In the example shown in FIGS. 1-3, the locking mechanism 46 releasably locks the handle 3 to the handle support 44. Also in the example shown in FIG. 3, the locking mechanism 46 includes a lock ring or bushing 5 for receiving a threaded set screw or other fastener 4 for extending through an opening in the ring 5 and a corresponding opening in the handle support 44. The fastener 4 bears against and holds the handle 3 fixed relative to the handle support 44. One or both of the openings can be threaded as desired to receive the fastener 4. The locking mechanism 46 provides for relatively easy release and locking of the handle within and relative to the handle support 44. The configuration of the locking mechanism 46 allows positioning of the handle at many locations along a continuum relative to the handle support, and such positions need not be predefined or discrete, and it allows such positioning substantially independent of the height positioning of the handle. Likewise, height positioning of the handle by the clamp 10 can be done substantially independently of the length positioning of the handle.

The adjustment assembly also allows the handle angle to be more easily adjusted in more confined areas, as the handle need not be removed from the handle support to change the angle of the handle. Adjustment of a handle can be made independent of the movement or raised or lowered position of the saw itself, subject to the existence of any adjacent barriers such as walls, or the like.

The handle 3 is preferably a conventional handle bar and easily fits within and is removable from the handle support 44. The handle 3 is formed and dimensioned so as to reliably allow an operator to move and position the saw as desired. The handle 3 includes a handle grip 9 at a free end portion 48 of the handle. The handle adjustment assembly 40 permits the free end portion of the handle to be adjusted relative to the saw. The free end portion of the handle may be moved closer to or further away from the saw by sliding the handle into or out of the handle support 44. The free end portion of the handle may be adjusted in its angle relative to the rest of the saw by pivoting the handle adjustment assembly 40 about the pivot point 34. The free end portion 48 of the handle can be fixed in position by the locking mechanism 46 and the threaded pin 13 in the arc opening 36. Other forms for supporting and releasably adjusting the position of the handle can be used.

The examples described allow adjustment of handle positions easily and quickly. The examples described have the pivot support spaced from the travel support, and in the example shown in FIG. 3, the pivot support is spaced longitudinally along the handle adjustment assembly 40 from the travel support. Additionally, the releasable holding element 10 and the locking mechanism 46 are spaced apart longitudinally of the handle.

Having thus described several exemplary implementations of the invention, it will be apparent that various alterations and modifications can be made without departing from the inventions or the concepts discussed herein. Such operations and modifications, though not expressly described above, are nonetheless intended and implied to be within the spirit and scope of the inventions. Accordingly, the foregoing description is intended to be illustrative only.

What is claimed is:

1. A concrete cutting saw comprising:

a frame for supporting a saw blade and for supporting a drive element for driving a saw blade;

at least one wheel coupled to the frame for supporting the frame on a surface and allowing the frame to move along the surface;

a handle having a first end portion and a second end portion and positioned relative to the frame so as to allow a portion of the frame to be lifted from the surface by moving on the first end portion;

a handle support supported by the frame and supporting the handle, the handle support including a first portion configured for pivotal movement relative to the frame and a second portion spaced from the first portion in the direction of the handle second end portion and configured to be releasably fixed against angular movement relative to the frame;

wherein the handle support extends linearly and wherein the first portion for pivotal movement includes a pin supported by the frame so as to allow pivotal movement of the handle support about the pin;

wherein the second portion releasably fixed relative to the frame includes a second pin movable relative to the frame;

a releasable clamp coupled to the second pin; and a surface supported by the frame and wherein the releasable clamp clamps against the surface.

2. A concrete cutting saw comprising:

a frame for supporting a saw blade and for supporting a drive element for driving a saw blade;

at least one wheel coupled to the frame for supporting the frame on a surface and allowing the frame to move along the surface;

a handle having a first end portion and a second end portion and positioned relative to the frame so as to allow a portion of the frame to be lifted from the surface by moving on the first end portion;

a handle support supported by the frame and supporting the handle, the handle support including a first portion configured for pivotal movement relative to the frame and a second portion spaced from the first portion in the direction of the handle second end portion and configured to be releasably fixed against angular movement relative to the frame;

a side wall supported by the frame and wherein the handle support extends along the side wall;

wherein the handle support includes a pivot pin extending through a portion of the side wall and also includes a locking pin extending through a portion of the side wall; and wherein the side wall supports the pivot pin and wherein the side wall includes a wall defining an arcuate opening and wherein the locking pin extends within the arcuate opening.

3. The saw of claim 2 further including a locking element coupled to the locking pin wherein the locking element presses against the side wall when in a locked configuration.

4. The saw of claim 2 further including a locking element coupled to the locking pin and configured so that the locking element can lock the locking pin relative to the side wall at substantially any position within the arcuate opening.

5. A concrete cutting saw comprising:

a frame for supporting a saw blade and for supporting a drive element for driving a saw blade;

at least one wheel coupled to the frame for supporting the frame on a surface and allowing the frame to move along the surface;

a handle having a first end portion and a second end portion and positioned relative to the frame so as to allow a portion of the frame to be lifted from the surface by moving on the first end portion;

a handle support supported by the frame and supporting the handle, the handle support including a first portion configured for pivotal movement relative to the frame and a second portion spaced from the first portion in the direction of the handle second end portion and configured to be releasably fixed against angular movement relative to the frame;

a side wall supported by the frame and wherein the handle support extends along the side wall;

wherein the handle support includes a pivot pin extending through a portion of the side wall and also includes a locking pin extending through a portion of the side wall; and wherein the side wall includes a rear side wall portion and a forward side wall portion, wherein the pivot pin extends through the rear side wall portion and the locking pin extends through the forward side wall portion.

6. The saw of claim 5 wherein the handle support extends along the side wall in a substantially straight line.

7. The saw of claim 6 wherein the handle support includes a tubular element and a support structure wherein the support structure supports the tubular element and also supports the pivot pin and the locking pin.

8. A concrete saw comprising:

a frame for supporting a drive element;

a concrete saw blade supported by the frame and driven by the drive element;

a plurality of wheels coupled to the frame for supporting the frame on a concrete surface;

a handle supported by the frame for pivoting movement relative to the frame and including a releasable holding element for keeping the handle stationary relative to the frame and configured to allow the handle to be adjusted in height through an angle from a first position to a second position and also configured to allow the handle to be adjusted to intermediate positions between the first and second positions wherein the intermediate positions include at least three adjacent positions having unequal spacing between them; and a handle support supported by the frame and wherein the handle support supports the handle relative to the frame and wherein the handle support includes a pivot element for allowing the handle to pivot relative to the pivot element and wherein the handle includes a grip portion on one side of the pivot element and an end portion on a side of the pivot element opposite the grip portion and wherein the handle support includes a pivot pin extending into a first portion of the frame and wherein the releasable holding element includes an element extending into a second portion of the frame spaced apart from and forward of the first portion of the frame.

9. The saw of claim 8 wherein the handle support includes a handle support body and the pivot pin and the element extending into a second portion of the frame are substantially perpendicular to the handle support body.

10. A concrete saw comprising:

a frame for supporting a drive element;

a concrete saw blade supported by the frame and driven by the drive element;

a plurality of wheels coupled to the frame for supporting the frame on a concrete surface;

a handle supported by the frame for pivoting movement relative to the frame and including a releasable holding element for keeping the handle stationary relative to the frame and configured to allow the handle to be adjusted in height through an angle from a first position to a second position and also configured to allow the handle to be adjusted to intermediate positions between the first and second positions wherein the intermediate positions include at least three adjacent positions having unequal spacing between them; and a handle support between the handle and the frame wherein the handle support includes a pivot pin extending substantially perpendicular to the handle support and a lock pin extending substantially perpendicular to the handle support.

11. The saw of claim 10 wherein the frame includes a wall defining an arcuate opening and wherein the lock pin extends into the arcuate opening.

12. The saw of claim 10 wherein the pivot pin and the lock pin are on a common line substantially parallel to the handle.

* * * * *